US011851805B2

(12) United States Patent
Bodine et al.

(10) Patent No.: US 11,851,805 B2
(45) Date of Patent: Dec. 26, 2023

(54) DEFLECTOR ASSEMBLY FOR LAUNDRY APPLIANCE

(71) Applicant: WHIRLPOOL CORPORATION, Benton Harbor, MI (US)

(72) Inventors: Darryl C. Bodine, St. Joseph, MI (US); Ryan James Rutter, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 52 days.

(21) Appl. No.: 17/532,173

(22) Filed: Nov. 22, 2021

(65) Prior Publication Data

US 2023/0160134 A1 May 25, 2023

(51) Int. Cl.
*D06F 39/14* (2006.01)
*D06F 37/28* (2006.01)

(52) U.S. Cl.
CPC ..... *D06F 39/14* (2013.01); *D06F 37/28* (2013.01)

(58) Field of Classification Search
CPC ..... D06F 39/14; D06F 37/28
USPC ..... 68/3 R
See application file for complete search history.

(56) References Cited

U.S. PATENT DOCUMENTS

| | | | |
|---|---|---|---|
| 6,792,777 | B2 | 9/2004 | Shaw et al. |
| 3,464,560 | A1 | 6/2013 | Kim et al. |
| 8,464,561 | B2 | 6/2013 | Brinkmann |
| 8,528,223 | B2 | 9/2013 | Alisch et al. |
| 8,661,707 | B2 | 3/2014 | Dittmer et al. |
| 8,701,309 | B2 | 4/2014 | Park et al. |
| 8,875,416 | B2 | 11/2014 | Anderson et al. |
| 9,028,615 | B2 | 5/2015 | Eglmeier et al. |
| 9,045,849 | B2 | 6/2015 | Cevikkalp et al. |
| 9,045,853 | B2 | 6/2015 | Kim et al. |
| 9,051,679 | B2 | 6/2015 | Kwon et al. |
| 9,115,461 | B2 | 8/2015 | Anderson et al. |
| 9,121,128 | B2 | 9/2015 | Hong et al. |
| 9,429,311 | B2 | 8/2016 | Metz et al. |
| 9,637,855 | B2 | 5/2017 | Buso et al. |
| 9,816,223 | B2 | 11/2017 | Bae et al. |
| 9,822,475 | B2 | 11/2017 | Thorpe |
| 9,869,048 | B2 | 1/2018 | Burgess et al. |
| 10,113,263 | B2 | 10/2018 | Ashrafzadeh et al. |
| 10,167,588 | B2 | 1/2019 | Kim et al. |
| 10,301,760 | B2 | 5/2019 | Kim et al. |
| 10,422,064 | B2 | 9/2019 | Seong et al. |
| 10,465,332 | B2 | 11/2019 | Simon et al. |

(Continued)

FOREIGN PATENT DOCUMENTS

| | | |
|---|---|---|
| CN | 109137408 A | 1/2019 |
| CN | 108729149 B | 6/2019 |

(Continued)

OTHER PUBLICATIONS

KR20060013831A—machine translation (Year: 2006).*

*Primary Examiner* — Tinsae B Ayalew
(74) *Attorney, Agent, or Firm* — Price Heneveld LLP

(57) ABSTRACT

A deflector assembly for an appliance includes a deflector having a rim forming a geometric shape and configured to engage a panel and a chute extending from a portion of the rim. The chute includes an upper surface that extends at an oblique angle from the rim. A lighting unit has a light source. The light source is disposed proximate to a junction between the rim and the chute.

20 Claims, 9 Drawing Sheets

(56) References Cited

U.S. PATENT DOCUMENTS

| | | | |
|---|---|---|---|
| 10,822,738 | B2 | 11/2020 | Chi et al. |
| 2005/0257573 | A1 | 11/2005 | Henssler et al. |
| 2007/0024056 | A1 | 2/2007 | Borland |
| 2007/0295037 | A1 | 12/2007 | Blomberg et al. |
| 2008/0037275 | A1 | 2/2008 | Eblenkamp et al. |
| 2010/0139366 | A1 | 6/2010 | Krausch |
| 2014/0083145 | A1 | 3/2014 | Bondi |
| 2018/0038040 | A1 | 2/2018 | Kim et al. |
| 2018/0306963 | A1 | 10/2018 | Klimecki |
| 2019/0177905 | A1 | 6/2019 | Ayers et al. |
| 2020/0370222 | A1 | 11/2020 | Bodine et al. |

FOREIGN PATENT DOCUMENTS

| | | | | |
|---|---|---|---|---|
| CN | 110699926 | A | | 1/2020 |
| DE | 3843386 | C2 | | 4/1996 |
| DE | 4126966 | C2 | | 10/1997 |
| EP | 2604741 | B1 | | 10/2015 |
| EP | 2527517 | B1 | | 4/2016 |
| KR | 20060013831 | A | * | 2/2006 |
| WO | 2014037840 | A1 | | 3/2014 |
| WO | 2016103095 | A1 | | 6/2016 |

* cited by examiner

DEFLECTOR ASSEMBLY FOR LAUNDRY APPLIANCE

BACKGROUND OF THE DISCLOSURE

The present disclosure generally relates to a deflector assembly, and more specifically, to a deflector assembly for a laundry appliance.

SUMMARY OF THE DISCLOSURE

According to one aspect of the present disclosure, a laundry appliance includes a cabinet having a front panel defining an access opening, a tub disposed within an interior of the cabinet, a bellows extending between the cabinet and the tub, a drum disposed within the tub, and a deflector assembly coupled to the front panel. The deflector assembly includes a deflector having a rim extending about at least a portion of a perimeter of the access opening and a chute extending from the rim, over the bellows, and toward the drum. A lighting unit includes light sources coupled to the deflector. The light sources selectively direct light into the drum. The light includes an edge lighting effect along an interior edge of the deflector.

According to another aspect of the present disclosure, an appliance deflector assembly includes a panel defining an opening and a deflector coupled to the panel. The deflector includes a rim coupled to a surface of the panel and extending about at least a portion of a perimeter of the opening and a chute coupled to the rim and extending through the opening. A lighting unit is coupled to the deflector. The lighting unit includes light sources arranged along at least a portion of the perimeter of the opening. The deflector defines a light guide to generate a lighting effect along an edge of the deflector.

According to yet another aspect of the present disclosure, a deflector assembly for an appliance includes a deflector having a rim forming a geometric shape and configured to engage a panel and a chute extending from a portion of the rim. The chute includes an upper surface that extends at an oblique angle from the rim. A lighting unit has a light source. The light source is disposed proximate to a junction between the rim and the chute.

These and other features, advantages, and objects of the present disclosure will be further understood and appreciated by those skilled in the art by reference to the following specification, claims, and appended drawings.

Figure 1:
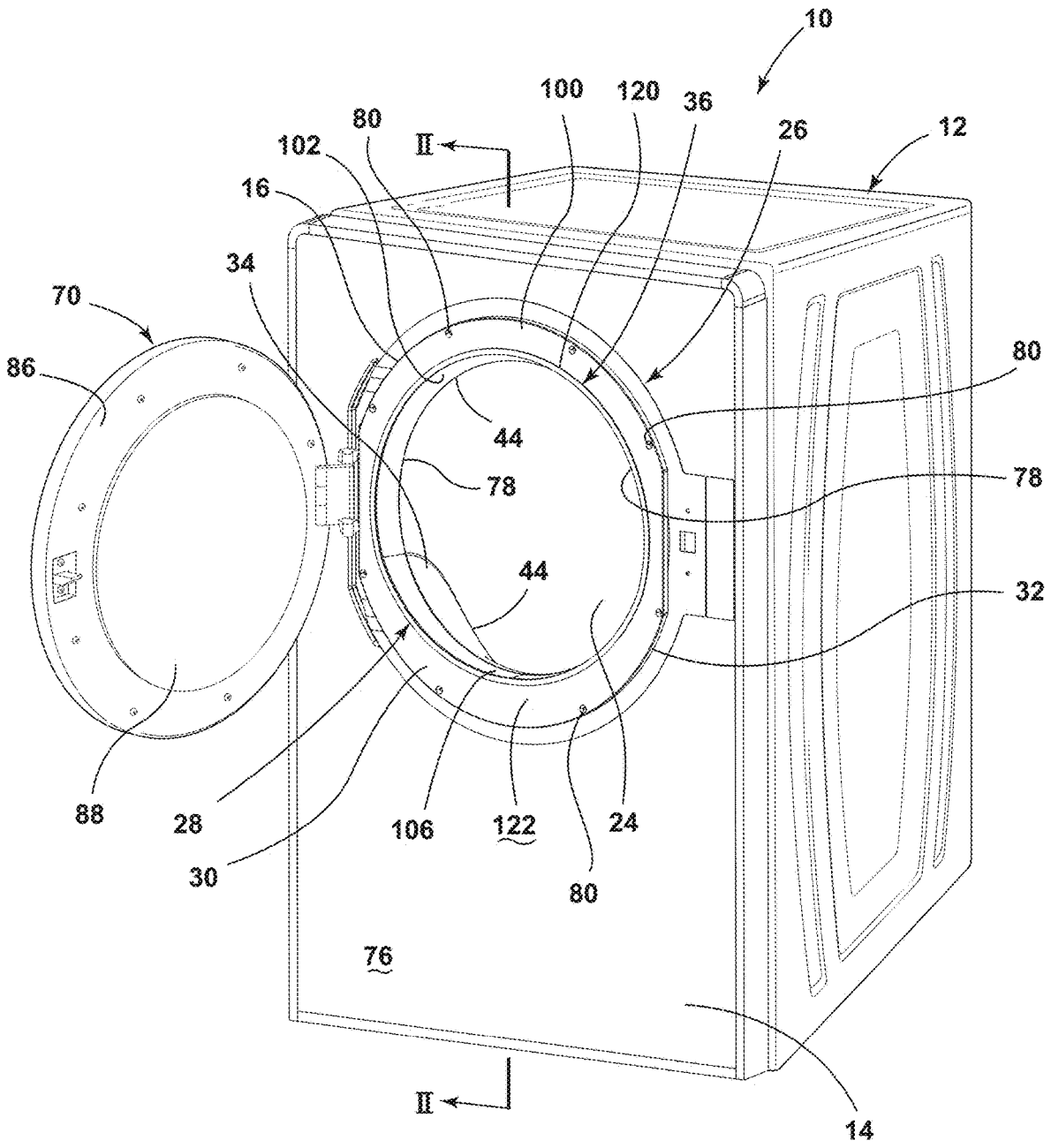
FIG. 1 is a side perspective view of a laundry appliance including a deflector assembly, according to the present disclosure.

The components in the figures are not necessarily to scale, emphasis instead being placed upon illustrating the principles described herein.

DETAILED DESCRIPTION

The present illustrated embodiments reside primarily in combinations of method steps and apparatus components related to a deflector assembly for a laundry appliance. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises a . . . " does not, without more constraints, preclude the existence of additional identical elements in the process, method, article, or apparatus that comprises the element.

With reference to FIGS. 1-12, reference numeral 10 generally designates a laundry appliance that includes a cabinet 12 having a front panel 14 defining an access opening 16. A tub 18 is disposed within an interior 20 of the cabinet 12. A bellows 22 extends between the cabinet 12 and the tub 18. A drum 24 is disposed within the tub 18. A deflector assembly 26 is coupled to the front panel 14. The deflector assembly 26 includes a deflector 28 having a rim 30 extending about at least a portion of a perimeter 32 of the access opening 16 and a chute 34 extending from the rim 30, over the bellows 22, and toward the drum 24. The deflector assembly 26 also includes a lighting unit 36 including light sources 38 coupled to the deflector 28. The light sources 38 direct light 40 into the drum 24. The light 40 includes an edge lighting effect 42 along an interior edge 44 of the deflector 28.

Figure 2:
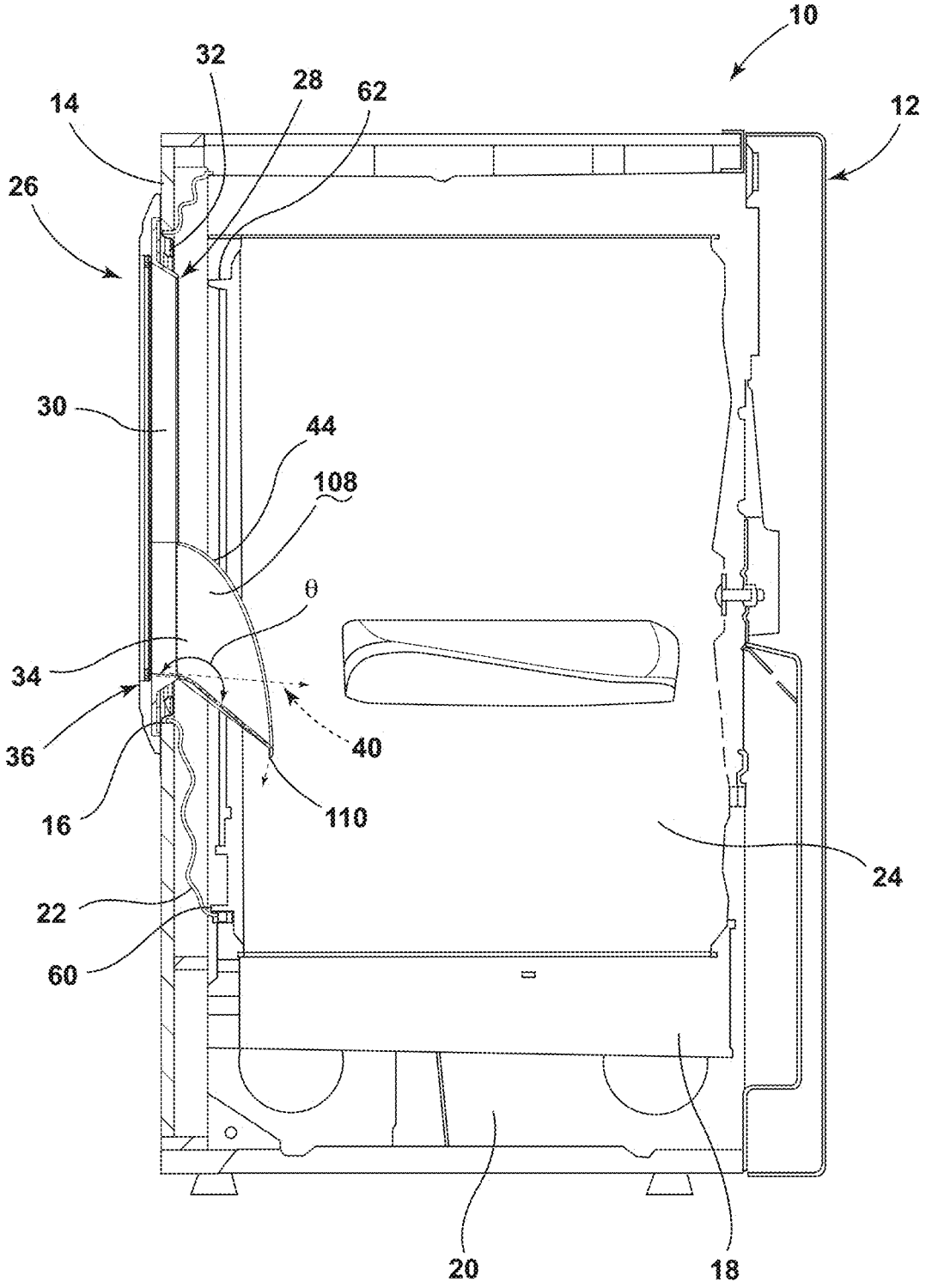
FIG. 2 is a cross-sectional view of the laundry appliance of FIG. 1, taken along line II-II.

With reference to FIGS. 1 and 2, the laundry appliance 10 includes the cabinet 12, which defines the access opening 16 in the front panel 14 thereof. The tub 18 is disposed within the interior 20 of the cabinet 12 and defines a front opening 60, which is generally aligned with the access opening 16 of the cabinet 12. The drum 24 is disposed within the tub 18 and includes a drum opening 62 that is generally substantially concentrically aligned with the front opening 60 of the tub 18. In certain aspects, the drum opening 62 can be offset from the access opening 16 of the cabinet 12. In such examples, the drum opening 62 is typically at least partially positioned below the access opening 16 of the cabinet 12. Additionally, when the access opening 16 is offset, the tub 18 and the drum 24 are generally positioned at an angle within the cabinet 12 of the laundry appliance 10.

In various examples, the bellows 22 is disposed adjacent to the access opening 16 of the cabinet 12. The bellows 22 is typically coupled to the cabinet 12 about the perimeter 32 of the access opening 16 and is also coupled to the tub 18 about a perimeter of the front opening 60. The bellows 22 extends between the cabinet 12 and the tub 18. The bellows 22 is typically configured as a flexible gasket permitting the tub 18 to move substantially independently of the cabinet 12. In examples where the tub 18 and the drum 24 are positioned at an angle within the cabinet 12, the bellows 22 can be an obliquely oriented bellows 22. The bellows 22 can be configured to form an oblique cylinder or frusto-conical shape that defines a downward angle between the access opening 16 and the front opening 60 of the offset tub 18. The bellows 22 may be advantageous for retaining items (e.g., laundry) within the tub 18 during a laundry cycle. In such configurations, the bellows 22 can form a sloped surface to direct fluid (e.g., water, laundry chemistry, etc.) into the drum 24 or the tub 18.

The laundry appliance 10 is illustrated in FIG. 1 as a horizontal axis washer. The laundry appliance 10 may be a vertical axis washer. In addition, the laundry appliance 10 can be a dryer, a combination washer/dryer, or another laundry appliance 10. It is also contemplated that the deflector assembly 26 may be utilized with other household or commercial appliances.

The laundry appliance 10 includes a door 70 coupled to the cabinet 12 for selectively allowing access to the drum 24. In the illustrated example of FIG. 1, the door 70 is a swing, hinged door 70 rotatably coupled to the cabinet 12 and configured to rotate about a vertical axis between an opened position and a closed position. The door 70 may also be configured to rotate about an angled or horizontal axis. In various examples, the door 70 may be a flat panel door 70, or alternatively, a fishbowl-style door 70. In additional or alternative examples, the door 70 can be a sliding door 70, which is configured to move horizontally or vertically between the opened and closed positions without departing from the teachings herein.

With reference to FIGS. 1 and 2, the laundry appliance 10 includes the deflector assembly 26 coupled to the front panel 14 of the cabinet 12. The deflector 28 is coupled to an outer surface 76 of the front panel 14 and can extend about the perimeter 32 of the access opening 16. In the illustrated configuration, the rim 30 extends around the entirety of the perimeter 32 of the access opening 16; however, it is contemplated that the rim 30 may extend about a portion of the perimeter 32 without departing from the teachings herein. The rim 30 forms or defines a geometric shape, which is typically a circular or oblong shape. The rim 30 defines a central aperture 78, which aligns with the access opening 16 of the front panel 14 to allow access to the drum 24.

The rim 30 is coupled to the front panel 14 via multiple attachment points 80 with coupling members. The coupling members may be screws, bolts, rivets, or other coupling features to mechanically fasten the deflector assembly 26 to the front panel 14. The rim 30 of the deflector 28 is configured to be substantially concealed by the door 70 when the door 70 is in the closed position, which substantially conceals the attachment points 80.

In the illustrated configuration of FIG. 1, the door 70 includes a perimeter portion 86, which is set back from a central viewing portion 88. The central viewing portion 88 may be a window, a transparent section, or a partially translucent section. When the door 70 is in the closed position, the rim 30 of the deflector 28 may abut the perimeter portion 86 while the central viewing portion 88 extends at least partially through the central aperture 78 defined by the rim 30. It is contemplated that the perimeter portion 86 may be flush or co-planar with the central viewing portion 88 without departing from the teachings herein.

Figure 3:
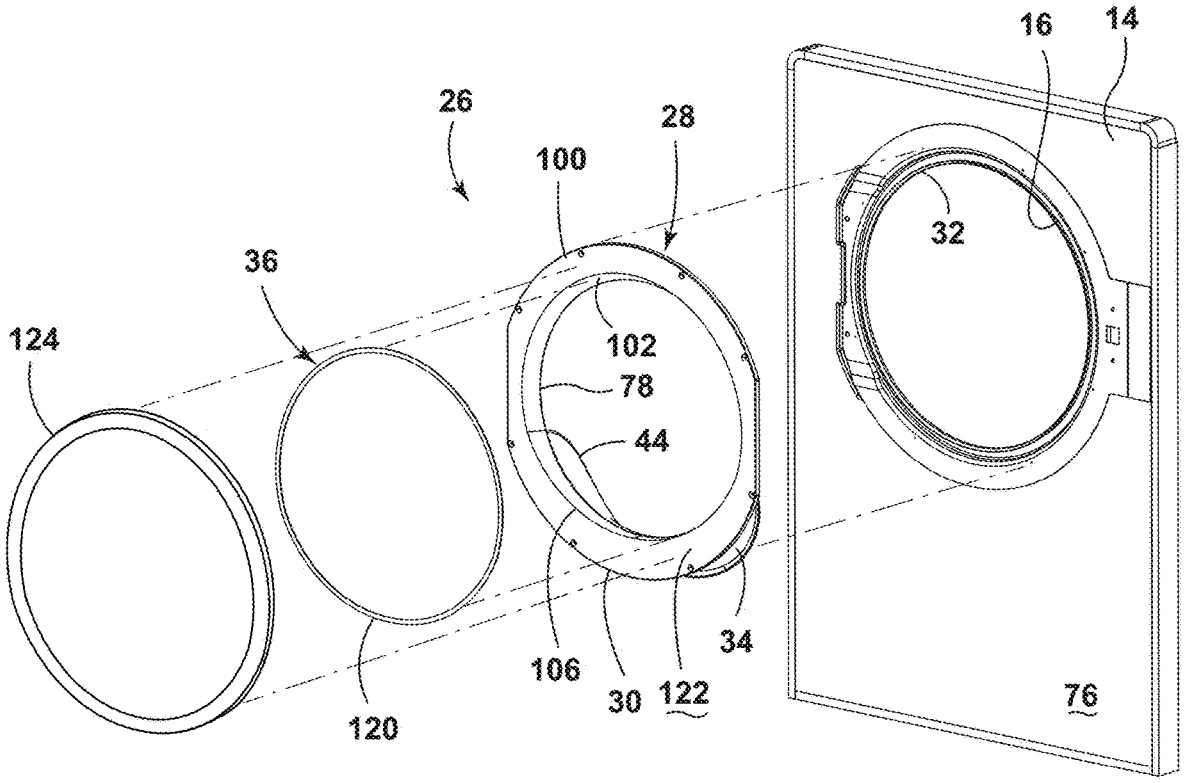
FIG. 3 is an exploded side perspective view of a deflector assembly and a front panel of an appliance cabinet, according to the present disclosure.
Figure 4:
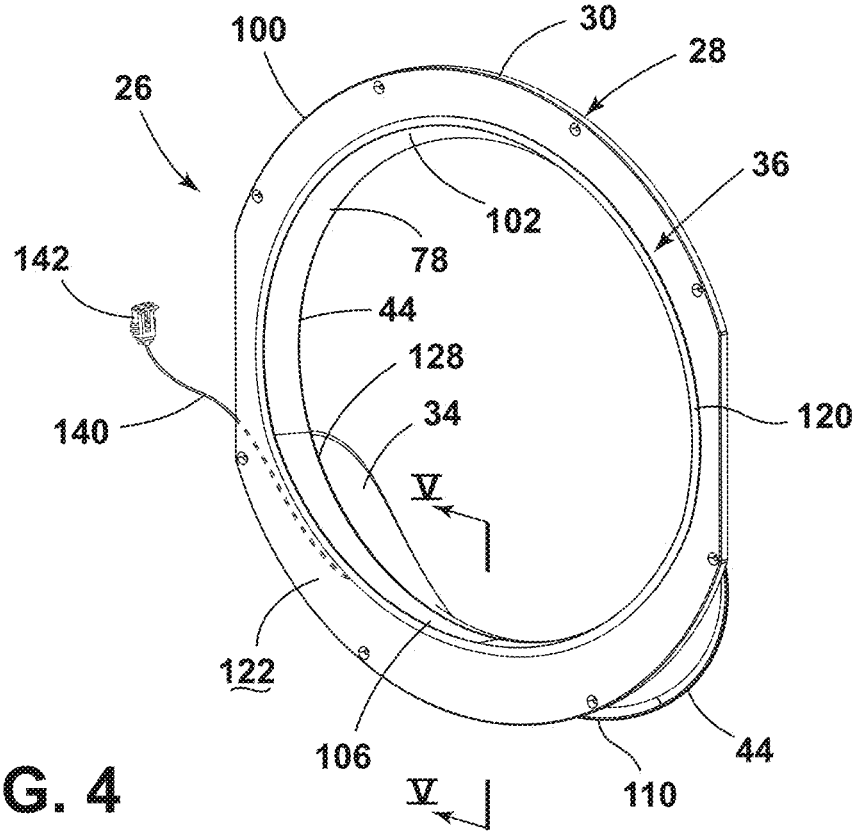
FIG. 4 is a side perspective view of a deflector assembly including a deflector and a lighting unit, according to the present disclosure.

With reference to FIG. 2, as well as FIGS. 3 and 4, the rim 30 includes an engaging portion 100, which is configured to abut the front panel 14, and an insertion portion 102, which is configured to extend at least partially through the access opening 16 of the cabinet 12. The deflector 28 includes the chute 34 extending from the rim 30. The insertion portion 102 and the chute 34 each extend in a same direction from the engaging portion 100. The chute 34 extends a greater distance from the engaging portion 100 compared to the insertion portion 102 of the rim 30. In the illustrated configuration of FIG. 2, the chute 34 extends from a lower portion 106 of the rim 30, through the access opening 16 of the front panel 14, and over the bellows 22. The chute 34 may also extend at least partially into the drum 24.

The chute 34 may extend from up to approximately 180° of the perimeter of the access opening 16. The chute 34 defines an arcuate body with an upper surface 108 that extends an oblique angle Θ from the rim 30. The deflector 28 may define a drip edge 110 which may be thickened and/or extend from the chute 34. The drip edge 110 can be advantageous to control fluid flow within the laundry appliance 10. For example, the drip edge 110 allows fluid on the deflector 28 to drip from the deflector 28 into the drum 24.

The chute 34 slopes downward and is figured as an obliquely oriented cylindrical section. The deflector 28 may be pliable, elastically deformable, rigid, and/or a combination thereof. The configurations where the bellows 22 are obliquely oriented may be advantageous to allow the deflector 28 to be oriented at a selected or desired angle, such that the deflector 28 can guide items away from the bellows 22 and toward the drum 24. The deflector 28 typically operates to prevent laundry or items from contacting the bellows 22. The deflector 28 is advantageous to protect the bellows 22, as well as to assist a consumer with loading items into the drum 24 for a laundry cycle. It is contemplated that the size and/or shape of the deflector 28 may be adjusted in response to the size and/or shape of the access opening 16 and the configuration of the laundry appliance 10.

With reference still to FIGS. 3 and 4, the deflector assembly 26 includes the lighting unit 36, which is configured as a light ring 120. The light ring 120 is configured to abut an outer surface 122 of the rim 30 and extend around the central aperture 78 of the deflector 28. A trim cover 124 may also be coupled to the deflector assembly 26 and/or the front panel 14. The trim cover 124 may be advantageous for concealing the light ring 120 from view. Additionally, the trim cover 124 may be utilized to conceal the attachment points 80 (FIG. 1) between the deflector 28 and the front panel 14. The trim cover 124 generally defines the same geometric shape as the rim 30 to fit over the rim 30. The trim cover 124 is concentrically aligned with the rim 30 to allow access to the drum 24. The trim cover 124 may be configured to be disposed over a portion of or the entirety of the engaging portion 100 of the rim 30. In this way, the consumer may see a portion of the rim 30 of the deflector 28 against the front panel 14, or alternatively, may not see the engaging portion 100 of the deflector 28.

Figure 5:
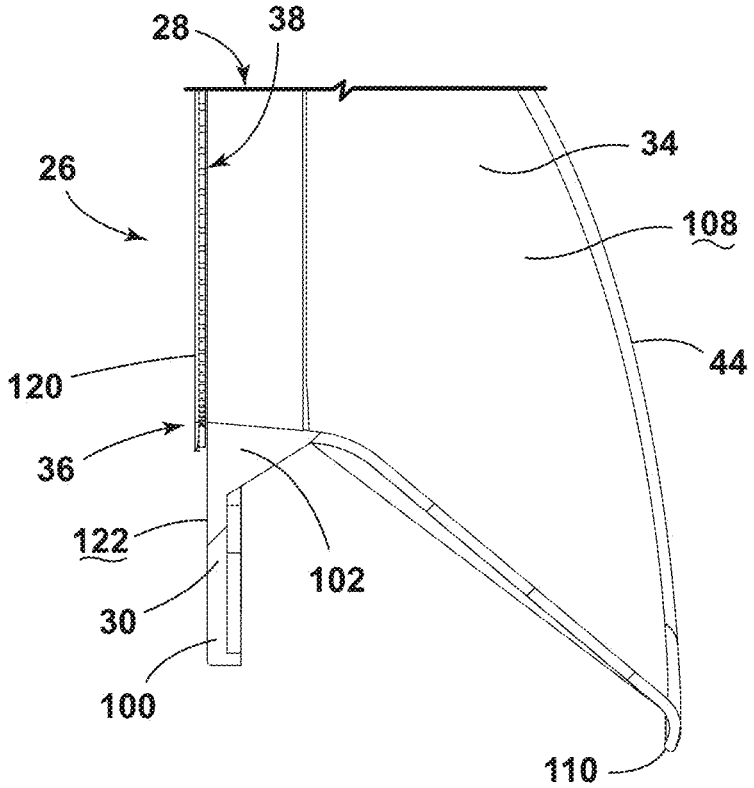
FIG. 5 is a partial cross-sectional view of the deflector assembly of FIG. 4, taken along line V-V.

With reference again to FIGS. 2 and 4, as well as FIG. 5, the lighting unit 36 is configured as the light ring 120. The light ring 120 is configured to abut the rim 30 with the light source 38 being oriented to emit light 40 toward the interior 20 of the drum 24. The light ring 120 is positioned to not substantially impede the central aperture 78 of the deflector 28. In certain aspects, the central aperture 78 is free of the light ring 120. In the illustrated example, the light ring 120 includes the light sources 38 arranged 360° around the central aperture 78 of the deflector 28. The light source 38 may be arranged at intervals, in a pattern, etc. It is contemplated that the light ring 120 includes the light source 38 extending about a portion of the central aperture 78, for example between approximately 90° and approximately 180° about the lower portion 106 of the rim 30. In such examples, the light ring 120 may extend entirely around the central aperture 78 without the light sources 38 in certain locations, or the lighting unit 36 may be configured as an arcuate band that extends about a portion of the rim 30.

In certain aspects, the rim 30 may define an annular groove configured to receive the light ring 120. In such examples, the light ring 120 may be substantially flush or coplanar with the outer surface 122 of the rim 30 of the deflector 28. Such configuration may be advantageous for fitting the deflector assembly 26 with the door 70 (FIG. 1). The light ring 120 may be mechanically fastened, adhered, or otherwise coupled to the deflector 28.

Figure 6:
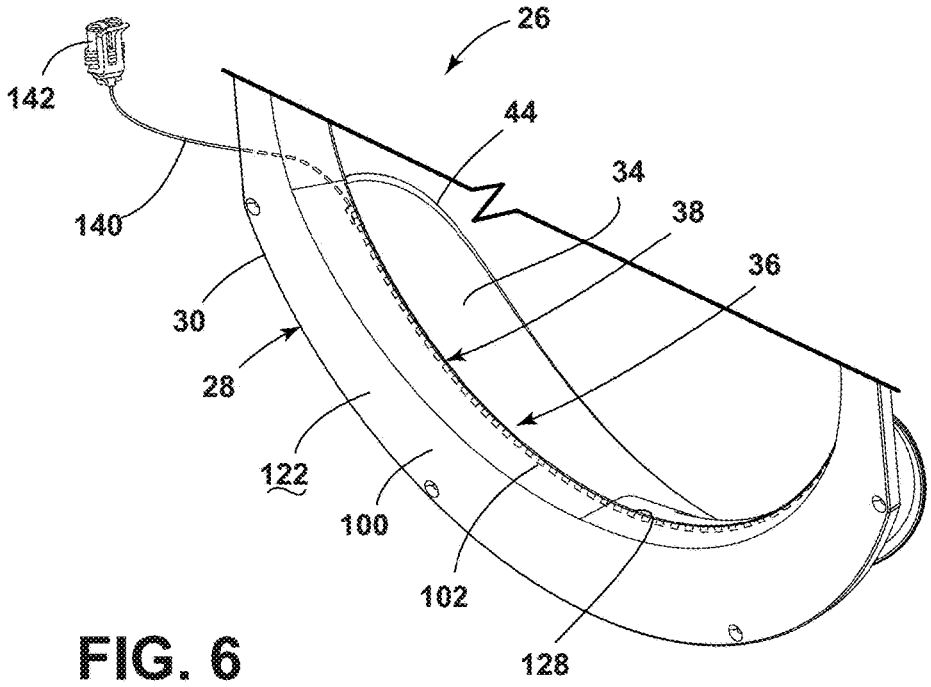
FIG. 6 is a partial side perspective view of a deflector assembly including a deflector with an integrated lighting unit, according to the present disclosure.

Referring now to FIG. 6, the lighting unit 36 may be integrally formed or integrated with the deflector 28. In the example illustrated in FIG. 6, the light sources 38 are arranged proximate to or along a junction 128 between the chute 34 and the rim 30. During the manufacturing process, the deflector 28 may be formed around the lighting unit 36, such that the light sources 38 are embedded or encapsulated in the deflector 28. It is contemplated that the light sources 38 may be disposed along the lower portion 106 of the rim 30, or entirely along the entire rim 30 around the central aperture 78. Embedding the lighting unit 36 in the deflector 28 can be a cost-effective solution.

Figure 7:
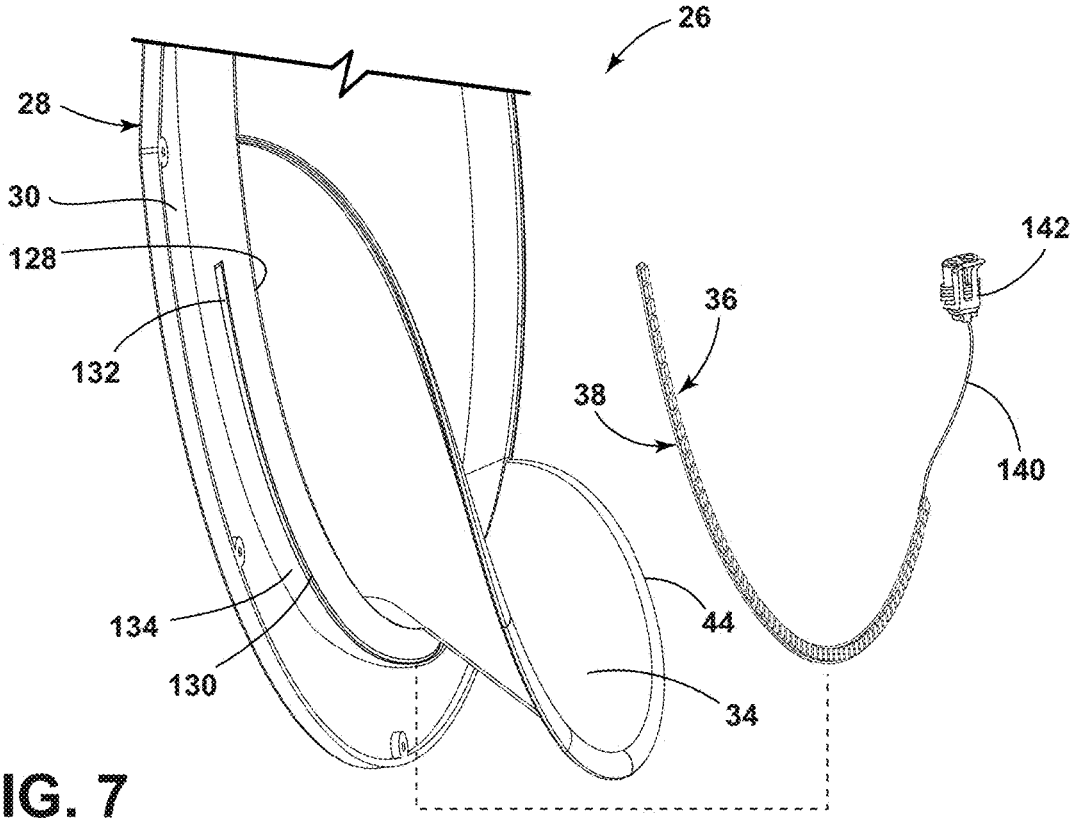
FIG. 7 is a partial exploded rear perspective view of a deflector assembly including a deflector defining a recess to selectively receive a lighting unit, according to the present disclosure.

Referring to FIG. 7, in an additional or alternative configuration, the lighting unit 36 may be configured as a lighting insert 130, which is selectively received by the deflector 28. In such examples, the lighting insert 130 may form a linear or arcuate body having the light source 38. The deflector 28 defines a recess 132, typically along or proximate to the junction 128 between the rim 30 and the chute 34. It may be advantageous for the recess 132 to be defined in a bottom 134 of the deflector 28, under the chute 34, to provide additional protection from fluid and wet items. The deflector 28 may be utilized with the lighting insert 130, or without the lighting insert 130. Prior to the installation into the laundry appliance 10 (FIG. 1), the lighting insert 130 may be positioned within the recess 132 of the deflector 28. The deflector 28 may include snap features, a cover, or another component to secure the lighting unit 36 to the deflector 28.

Referring again to FIGS. 4-7, the lighting unit 36 includes an electrical connector 140 coupled with each light source 38. The electrical connectors 140 are configured to provide power and control commands to the light sources 38. The electrical connectors 140 generally extend along or through the rim 30 of the deflector 28 between the light source 38. Additionally, the electrical connectors 140 include an engagement end 142, which extends away from the deflector 28. In examples where the lighting unit 36 is embedded within the deflector 28, the electrical connectors 140 extend through the deflector 28 to the light source 38 and out of the deflector 28 to allow access to the engagement end 142. The electrical connectors 140 are configured to be substantially concealed by the deflector 28 or the trim cover 124 (FIG. 3).

Figure 8:
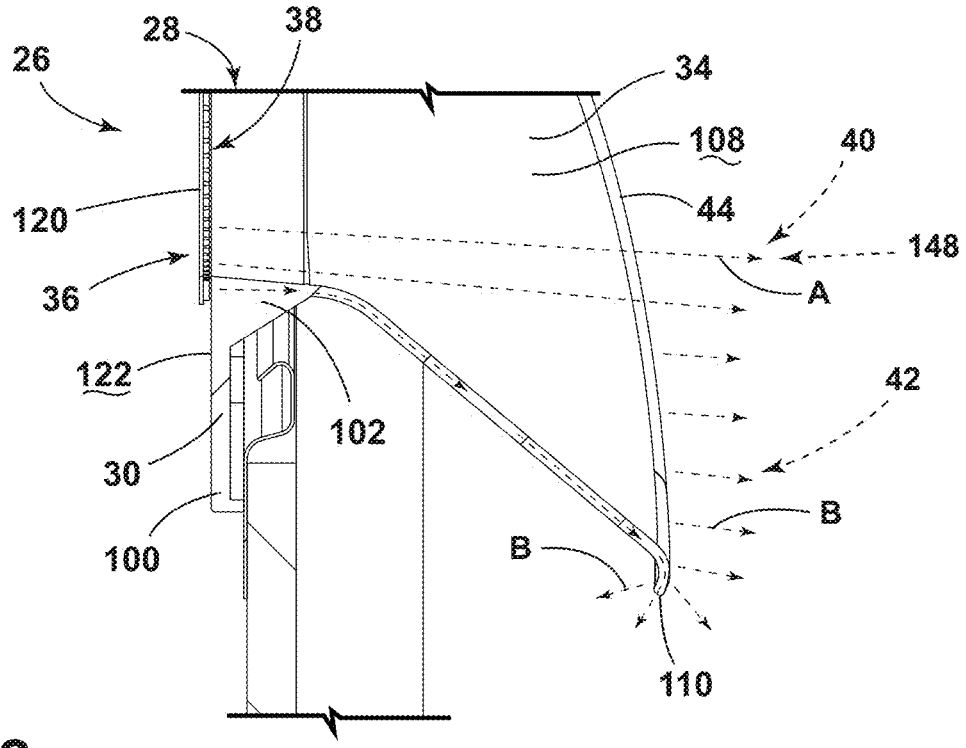
FIG. 8 is a partial cross-sectional view of a deflector assembly with a lighting unit generating lighting effects, according to the present disclosure.

With reference to FIG. 8, as well as FIGS. 2 and 4-7, the deflector 28 is typically constructed of a clear, transparent, semi-transparent, or at least partially translucent material, such as, for example, a plastic, a resin, an acrylic, etc. The clear, transparent, or translucent construction of the deflector 28 allows the deflector 28 to define a light guide for diffusing, directing, and guiding the light 40 emitted from the light source 38 in various directions. The light sources 38 are configured to generate at least two different lighting effects. For example, the light sources 38 direct light 40 into the interior 20 of the drum 24 to illuminate the interior 20 of the drum 24 (e.g., an illumination lighting effect 148), as indicated by arrows A. This allows for general interior lighting without additional lighting components being installed in the bellows 22 or the cabinet 12.

Additionally, the deflector 28 guides the light 40 emitted by the light sources 38 through the deflector 28, operating as the light guide. The light sources 38 direct light 40 into or towards the drum 24, and the light 40 includes the edge lighting effect 42. The light 40 travels through the deflector 28 and produces the edge lighting effect 42 along the interior edge 44 of the deflector 28, as indicated by arrows B. The interior edge 44 along the rim 30 and the chute 34 appears to glow from the edge lighting effect 42.

The light source 38 can include any form of light source. For example, fluorescent lighting, light-emitting diodes (LEDs), organic LEDs (OLEDs), polymer LEDs (PLEDs), laser diodes, quantum dot LEDs (QD-LEDs), solid-state lighting, hybrid, and/or any other similar device. Any other form of lighting may be utilized within the deflector assembly 26 without departing from the teachings herein.

Further, various types of LEDs are suitable for use in the deflector assembly 26, including, but not limited to, top-emitting LEDs and side-emitting LEDs. Moreover, according to various examples, multicolored light source 38 such as Red, Green, and Blue (RGB) LEDs that employ red, green, and blue LED packaging can be used to generate various desired colors of light 40 output from a single light source 38, according to known light color mixing techniques. The light sources 38 may emit any color lighting or any practicable wavelength of lighting, typically within the white or visible light wavelength spectrum (e.g., ~400-700 nm).

Figure 9:
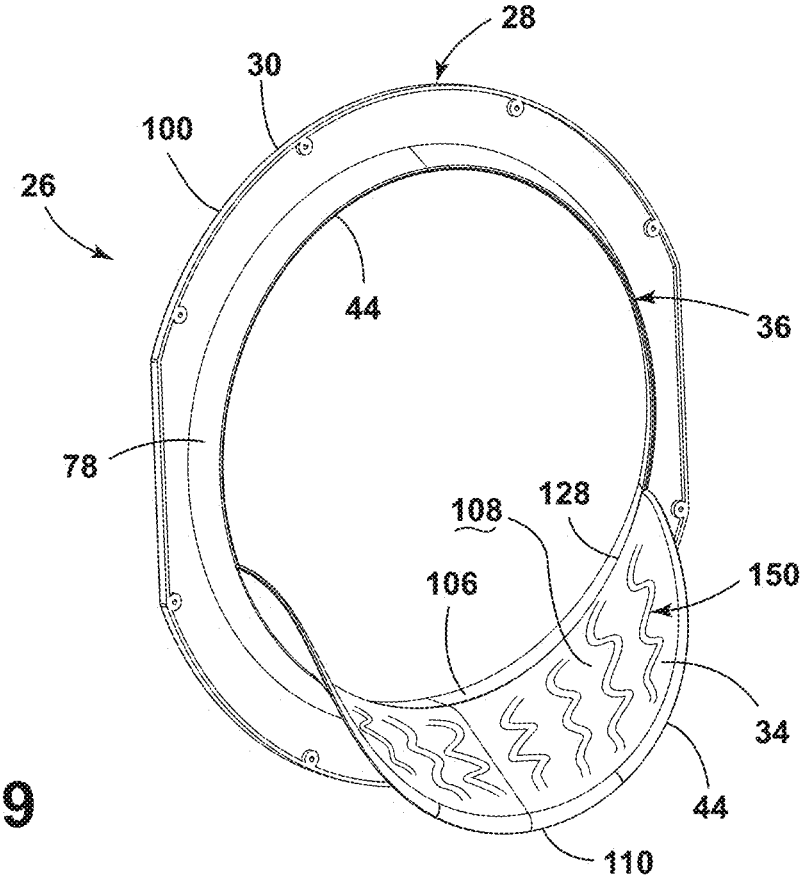
FIG. 9 is a side perspective view of a deflector assembly with a textured region defined in a chute of a deflector, according to the present disclosure.

Referring to FIG. 9, the chute 34 may have a textured region 150. The textured region 150 may be defined within the chute 34, on the upper surface 108 of the chute 34, or a combination thereof. The textured region 150 provides a different texture or consistency to the chute 34. In the illustrated example, the textured region 150 defines a design or pattern on the chute 34. The textured region 150 may define a word, a letter, a logo, a design, a pattern, an image, etc. configured to be illuminated by diffusion of the light 40 being directed through the chute 34. The textured region 150 may be formed during the manufacturing process, for example, as part of a molding process. Additionally or alternatively, the textured region 150 may be embossed or etched into the chute 34. The deflector 28 may include a single textured region 150, multiple textured regions 150 on discrete portions of the deflector 28, multiple types of textures, etc.

Figure 10:
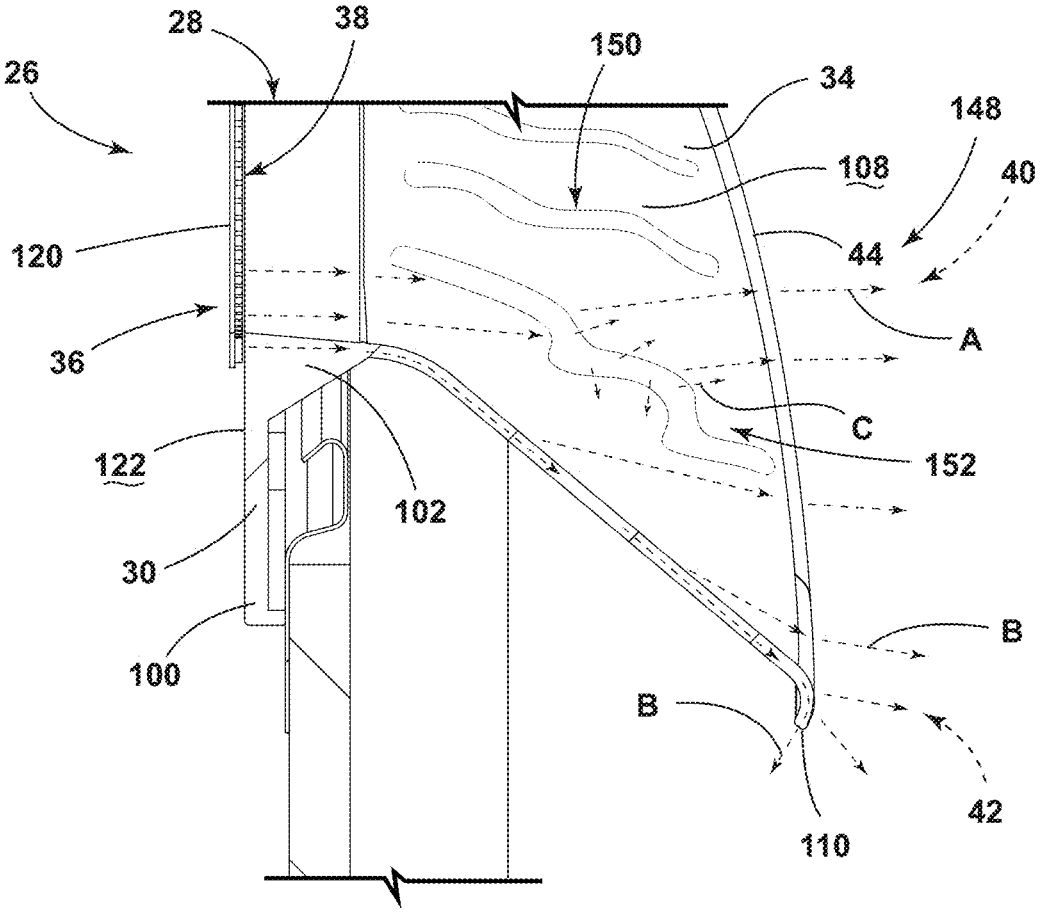
FIG. 10 is a partial cross-sectional view of a deflector assembly with a lighting unit generating lighting effects, according to the present disclosure.

With reference to FIG. 9, as well as FIG. 10, the textured region 150 may be less visible when the light sources 38 are activated compared to when the light sources 38 are activated. The textured region 150 disrupts the material of the chute 34, which consequently adjusts, diffuses, or otherwise redirects the light guide effect of the chute 34. The light sources 38 are configured to produce a third lighting effect in the deflector 28 having the textured region 150, which is a textured lighting effect 152 (also indicated by arrows C). The textured region 150 disrupts the direction of the light 40 being guided through the chute 34. The light 40 is diffused by the textured region 150 to illuminate the texture. The deflector assembly 26 having the textured region 150 illuminates the interior 20 of the drum 24, generates the edge lighting effect 42 along the interior edge 44 of the deflector 28, and generated the textured lighting effect 152 to illuminate the textured region 150 when the light sources 38 are activated. Accordingly, the light 40 selectively directed toward the drum 24 by the light sources 38 includes the illumination lighting effect 148, the edge lighting effect 42, and the textured lighting effect 152.

Figure 11:
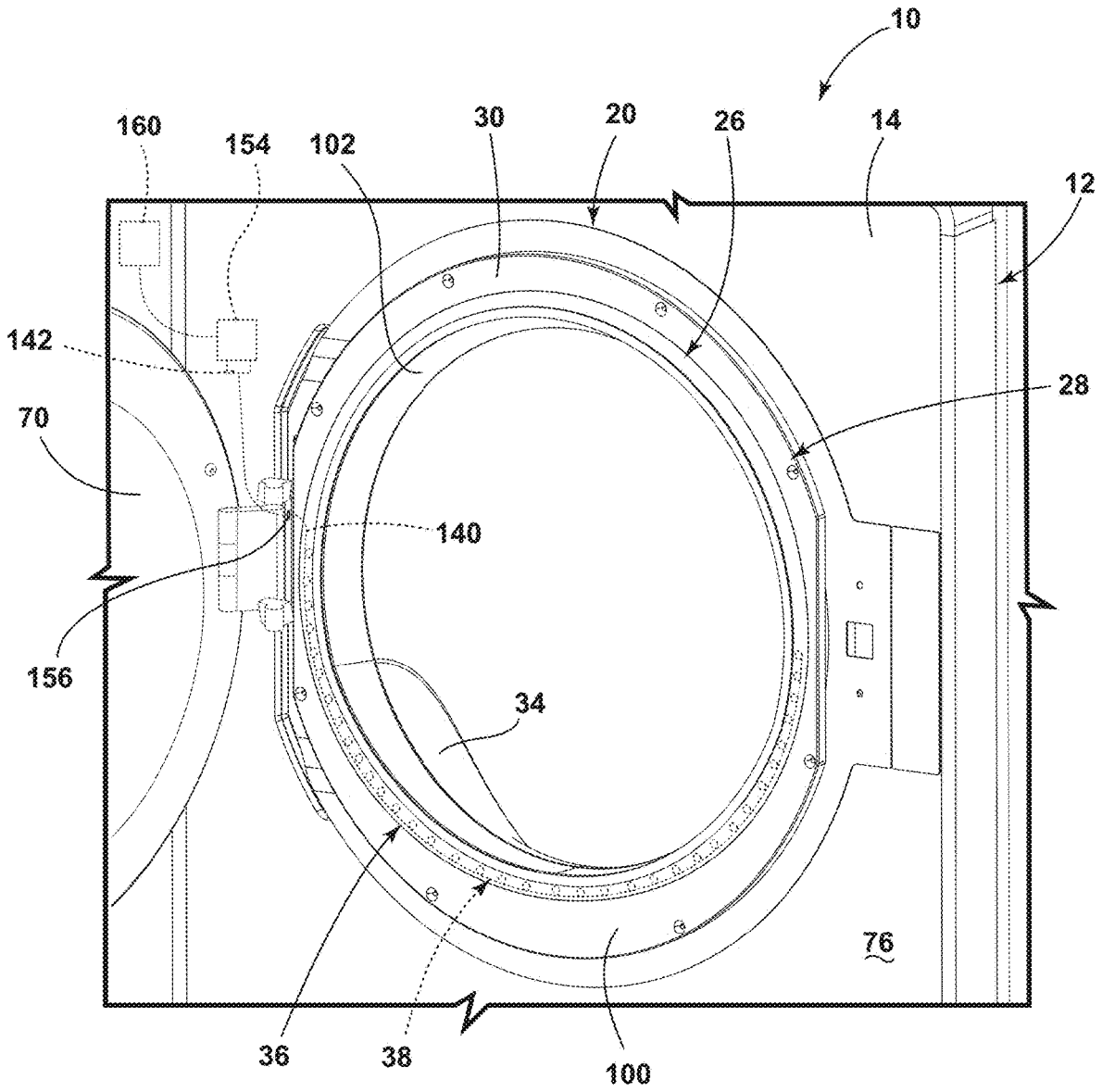
FIG. 11 is a partial front elevational view of a laundry appliance with a deflector assembly having an electrical connector that engages an interior wiring harness, according to the present disclosure.
Figure 12:
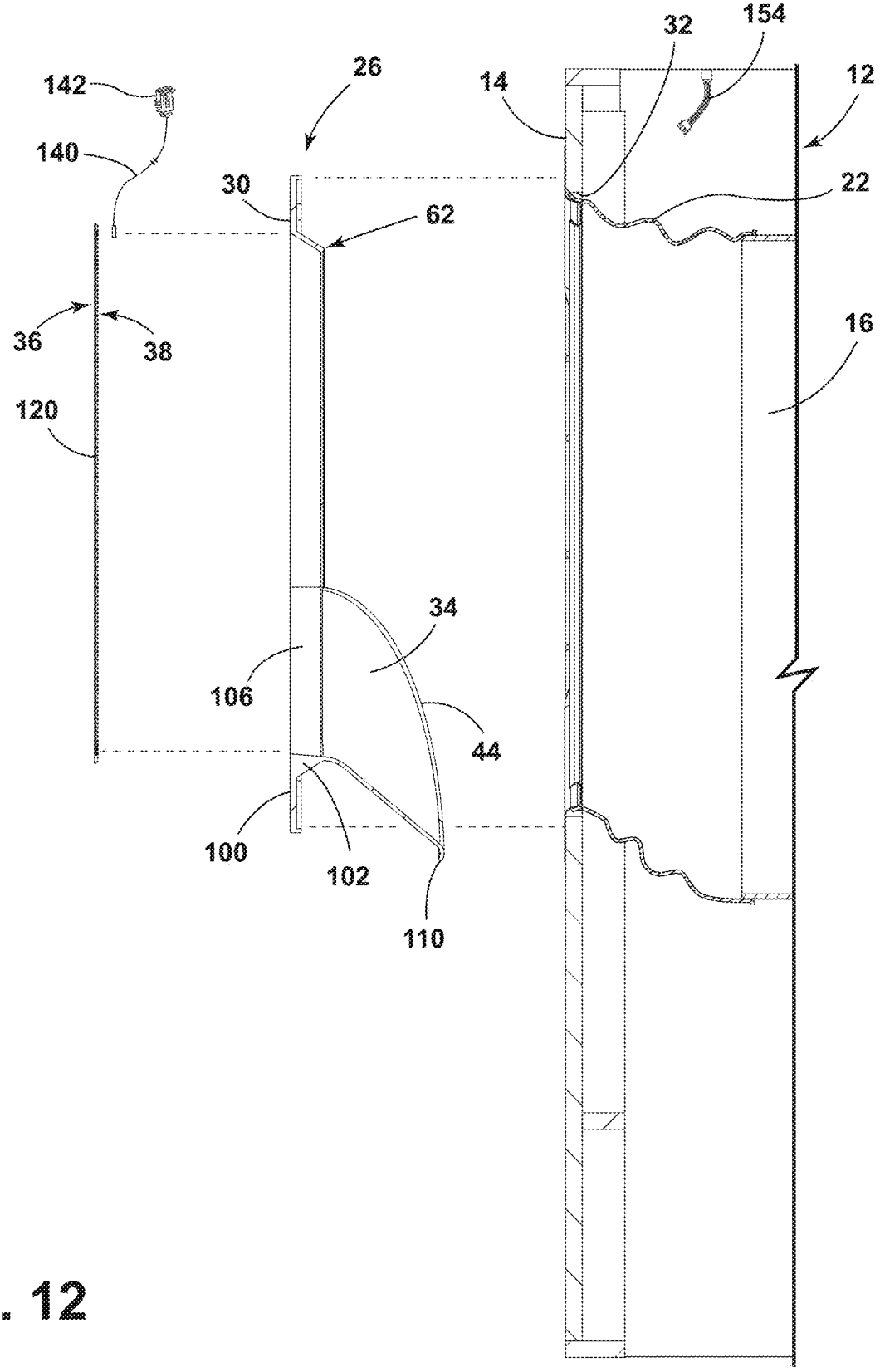
FIG. 12 is a partial exploded cross-sectional view of a laundry appliance with a deflector assembly having an electrical connector configured to extend through a panel of a cabinet to engage a wiring harness, according to the present disclosure.

Referring again to FIG. 2, as well as to FIGS. 11 and 12, the lighting unit 36 is coupled to the deflector 28 and includes the electrical connectors 140, which is configured to engage a wiring harness 154 of the laundry appliance 10. The wiring harness 154 is in electrical communication with each lighting aspect of the laundry appliance 10. The electrical connectors 140 are configured to extend from the light source 38 and along the rim 30 of the deflector 28 toward a connecting aperture 156 defined in the front panel 14.

The connecting aperture 156 is defined proximate to the access opening 16, typically in a position adjacent to or covered by the rim 30 of the deflector 28. The connecting aperture 156 connects an area proximate to the outer surface 76 of the front panel 14 with the interior 20 of the cabinet 12. The electrical connectors 140 are configured to extend through the connecting aperture 156 into the interior 20 of the cabinet 12. The engagement end 142 of the electrical connectors 140 are configured to couple to the wiring harness 154 inside the cabinet 12.

The electrical connectors 140 are configured to extend around the bellows 22. In many conventional washers, electrical components extend through a bellows assembly such that the bellows assembly has a hole to accommodate the electrical components. The disclosed configuration of the deflector assembly 26 allows the electrical connectors 140 to engage the wiring harness 154 without extending through the bellows 22. This may be advantageous for positioning the electrical aspects of the deflector assembly 26 further away from wet areas, such as the bellows 22.

With reference to FIGS. 1-12, the deflector assembly 26 is communicatively coupled with a controller 160 of the laundry appliance 10. The controller 160 is configured to selectively and independently control each light source 38 of the lighting unit 36 to selectively direct light 40 toward the drum 24. The controller 160 is configured to activate the light sources 38 to produce the selected lighting effects, such as the edge lighting effect 42, the textured lighting effect 152, and the illumination of the interior 20 of the drum 24 (e.g., the illumination lighting effect 148). Further, the deflector 28 defines the light guide to generate the selected light effects.

The controller 160 may also control the light source 38 to convey a message or a visual notification to the consumer or user. The laundry appliance 10 may include multiple programmed lighting patterns to convey information to the consumer. For example, when the laundry appliance 10 is turned to an on or activated state and the light source 38 are arranged in the light ring 120, the controller 160 may activate the light sources 38 to produce a moving circular lighting effect around the access opening 16. In another non-limiting example, when the light sources 38 are disposed at the junction 128 between the rim 30 and the chute 34, the light sources 38 may be selectively activated in a directional pattern (e.g., from left to right) to indicate a status of a laundry cycle (e.g., a lighting pattern synced to the laundry cycle). Additional or alternative lighting patterns are contemplated without departing from the teachings herein.

Use of the present device may provide for a variety of advantages. For example, the deflector 28 may be utilized to protect the bellows 22 and deflect items toward the interior 20 of the drum 24. Additionally, the lighting unit 36 within the deflector assembly 26 may be utilized to provide multiple lighting effects. The lighting unit 36 may illuminate the interior 20 of the drum 24, which assists the user in loading or unloading items as well as viewing the interior 20 of the drum 24. Additionally, the deflector 28 is constructed of a clear, transparent or translucent material, such that the deflector 28 operates as a light guide to direct the light 40 from the lighting unit 36 to produce the various lighting effects. The lighting unit 36 may be utilized to produce the edge lighting effect 42 as the light 40 travels through the deflector 28 to cause a glowing effect along the interior edge 44 of the deflector 28. Further, the lighting unit 36 may be utilized to produce the textured lighting effect 152 to illuminate the textured region 150. Further, the lighting unit 36 may also provide interior lighting within the drum 24. Moreover, the electrical connectors 140 from the lighting unit 36 extend through the front panel 14 to engage the wiring harness 154. In this way, the electrical connectors 140 extend around, and not through, the bellows 22. Additional benefits or advantages may be realized and/or achieved.

The device disclosed herein is further summarized in the following paragraphs and is further characterized by combinations of any and all of the various aspects described therein.

According to another aspect of the present disclosure, laundry appliance includes a cabinet having a front panel defining an access opening, a tub disposed within an interior of the cabinet, a bellows extending between the cabinet and the tub, a drum disposed within the tub, and a deflector assembly coupled to the front panel. The deflector assembly includes a deflector having a rim extending about at least a portion of a perimeter of the access opening and a chute extending from the rim, over the bellows, and toward the drum. A lighting unit includes light sources coupled to the deflector. The light sources direct light into the drum. The light includes edge lighting effect along an interior edge of the deflector.

According to another aspect, a wiring harness is disposed within a cabinet. A lighting unit of a deflector assembly includes an electrical connector coupled with each light source. The electrical connector is configured to couple with the wiring harness within an interior of the cabinet.

According to yet another aspect, an electrical connector extends from a deflector, through a connecting aperture defined by a front panel, and around a bellows to engage a wiring harness.

According to another aspect, a rim is coupled to an outer surface of a front panel and a chute extends through an access opening.

According to yet another aspect, a trim cover is coupled to a front panel of a cabinet. The trim cover extends at least partially over a rim of a deflector.

According to another aspect, a rim extends around an entirety of a perimeter of an access opening and a lighting unit forms a light ring around the access opening.

According to yet another aspect, a controller is communicatively coupled to a lighting unit. The controller is configured to selectively and independently control each light source to provide a visual notification.

According to another aspect of the present disclosure, an appliance deflector assembly includes a panel defining an opening and a deflector coupled to the panel. The deflector includes a rim coupled to a surface of the panel and extending about at least a portion of a perimeter of the opening and a chute coupled to the rim and extending through the opening. A lighting unit is coupled to the deflector. The lighting unit includes light sources arranged about at least a portion of the perimeter of the opening. The deflector defines a light guide to generate a lighting effect along an edge of the deflector.

According to another aspect, a lighting unit is embedded in a deflector.

According to yet another aspect, a deflector defines a recess. A lighting unit is selectively positioned in the recess.

According to another aspect, a chute defines a textured region configured to diffuse light being directed through a chute to generate a textured lighting effect.

According to yet another aspect, a textured region defines at least one of a logo, a word, a letter, a design, and an image configured to be illuminated by a textured lighting effect.

According to another aspect, a lighting unit is configured as a light ring disposed adjacent to and extending along a rim.

According to yet another aspect, a trim cover is coupled to a panel over a rim and configured to conceal attachment points between a rim and a panel.

According to another aspect of the present disclosure, a deflector assembly for an appliance includes a deflector having a rim forming a geometric shape and configured to engage a panel and a chute extending from a portion of the rim. The chute includes an upper surface that extends at an oblique angle from the rim. A lighting unit has a light source. The light source is disposed proximate to a junction between the rim and the chute.

According to another aspect, a deflector defines a recess for selectively receiving a lighting unit.

According to yet another aspect, a rim and the chute are constructed of at least one of a transparent material and a translucent material configured to operate as a light guide for light emitted by a light source to produce a lighting effect along an edge of a deflector.

According to another aspect, a chute defines a textured region configured to diffuse light emitted from a light source.

According to yet another aspect, a rim forms a circular shape. A chute extends about the portion of the rim to define an arcuate body.

According to another aspect, a rim includes an engaging portion configured to engage a panel and an insertion portion extending in a same direction from the engaging portion as a chute.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes, and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A laundry appliance, comprising:

a cabinet having a front panel defining an access opening;

a tub disposed within an interior of the cabinet;

a bellows extending between the cabinet and the tub;

a drum disposed within the tub;

a deflector assembly coupled to the front panel, wherein the deflector assembly includes:

a deflector having a rim extending about at least a portion of a perimeter of the access opening and a chute extending from the rim, over the bellows, and toward the drum; and a lighting unit including light sources coupled to the deflector, wherein the light sources selectively direct light into the drum, and wherein the light includes an edge lighting effect along an interior edge of the deflector; and a wiring harness disposed within the cabinet, wherein the lighting unit of the deflector assembly includes an electrical connector coupled with each light source, wherein the electrical connector is configured to couple with the wiring harness within the interior of the cabinet, and wherein the electrical connector extends from the deflector, through a connecting aperture defined by the front panel, and around the bellows to engage the wiring harness.

2. The laundry appliance of claim 1, wherein the rim is coupled to an outer surface of the front panel and the chute extends through the access opening.

3. The laundry appliance of claim 1, further comprising:

a trim cover coupled to the front panel of the cabinet, wherein the trim cover extends at least partially over the rim of the deflector.

4. The laundry appliance of claim 1, wherein the rim extends around an entirety of the perimeter of the access opening and the lighting unit forms a light ring around the access opening.

5. The laundry appliance of claim 1, further comprising:

a controller communicatively coupled to the lighting unit, wherein the controller is configured to selectively and independently control each light source to provide a visual notification.

6. An appliance deflector assembly, comprising:

a panel defining an opening;

a deflector coupled to the panel, wherein the deflector includes:

a rim coupled to a surface of the panel and extending about at least a portion of a perimeter of the opening; and a chute coupled to the rim and extending through the opening; and a lighting unit coupled to the deflector, wherein the lighting unit includes:

light sources arranged about at least the portion of the perimeter of the opening, wherein the deflector defines a light guide to generate a lighting effect along an edge of the deflector; and an electrical connector communicatively coupled with the light sources, the electrical connector configured to extend from the light sources and through a connecting aperture defined by the panel to engage a wiring harness.

7. The appliance deflector assembly of claim 6, wherein the lighting unit is embedded in the deflector.

8. The appliance deflector assembly of claim 6, wherein the deflector defines a recess, and wherein the lighting unit is selectively positioned in the recess.

9. The appliance deflector assembly of claim 6, wherein the chute defines a textured region configured to diffuse light being directed through the chute to generate a textured lighting effect.

10. The appliance deflector assembly of claim 9, wherein the textured region defines at least one of a logo, a word, a letter, a design, and an image configured to be illuminated by the textured lighting effect.

11. The appliance deflector assembly of claim 6, wherein the lighting unit is configured as a light ring disposed adjacent to and extending along the rim.

12. The appliance deflector assembly of claim 6, further comprising:

a trim cover coupled to the panel over the rim and configured to conceal attachment points between the rim and the panel.

13. The appliance deflector assembly of claim 6, wherein the electrical connector is configured to extend from an area adjacent to an outer surface of the panel to an area adjacent to an inner surface of the panel.

14. The appliance deflector assembly of claim 11, wherein the light ring abuts an outer surface of the rim of the deflector.

15. A deflector assembly for an appliance, comprising:

a deflector including:

a rim forming a geometric shape and configured to engage a panel, wherein the rim includes an engaging portion for engaging the panel and an insertion portion extending from the engaging portion; and a chute extending from the insertion portion, wherein the chute includes an upper surface that extends at an oblique angle from the rim; and a lighting unit having a light source, wherein the light source is coupled to the insertion portion between the engaging portion and the chute, and wherein the lighting unit includes an electrical connector configured to extend from the light source and through an aperture defined in the panel to an interior of said appliance.

16. The deflector assembly of claim 15, wherein the deflector defines a recess for selectively receiving the lighting unit.

17. The deflector assembly of claim 15, wherein the rim and the chute are constructed of at least one of a transparent material and a translucent material configured to operate as a light guide for light emitted by the light source to produce a lighting effect along an edge of the deflector.

18. The deflector assembly of claim 15, wherein the chute defines a textured region configured to diffuse light emitted from the light source.

19. The deflector assembly of claim 15, wherein the rim forms a circular shape, and wherein the chute extends about the insertion portion of the rim to define an arcuate body.

20. The deflector assembly of claim 15, wherein the rim includes the engaging portion configured to engage the panel and the insertion portion extending in a same direction from the engaging portion as the chute.

* * * * *